United States Patent [19]

Fusco

[11] Patent Number: 4,577,617

[45] Date of Patent: Mar. 25, 1986

[54] VESTIBULE FOR ANY STOVE

[76] Inventor: Frank Fusco, Pennsylvania, U.S.A.

[21] Appl. No.: 673,033

[22] Filed: Nov. 19, 1984

[51] Int. Cl.[4] ..... F24C 15/08

[52] U.S. Cl. ..... 126/279

[58] Field of Search ..... 126/123, 126, 279, 67, 126/110 B, 114, 131

[56] References Cited

U.S. PATENT DOCUMENTS

| | | | |
|---|---|---|---|
| 10,700 | 3/1854 | Chatfield | 126/114 |
| 105,773 | 7/1870 | Brownell | 126/279 |
| 1,656,326 | 1/1928 | Johnson | 126/123 |
| 1,695,658 | 12/1928 | Lange | 126/67 |
| 2,131,763 | 10/1938 | Sruat | 126/110 B |
| 3,190,281 | 6/1965 | Northwood | 126/120 |
| 4,026,264 | 5/1977 | Henriques | 126/123 |
| 4,219,007 | 8/1980 | Peickert et al. | 126/279 |
| 4,271,815 | 6/1981 | Johnson | 126/126 X |
| 4,369,761 | 1/1983 | Burnette | 126/67 X |
| 4,440,342 | 4/1984 | Flagg | 126/131 X |

FOREIGN PATENT DOCUMENTS

| | | | |
|---|---|---|---|
| 56457 | 4/1936 | Norway | 126/279 |

*Primary Examiner*—Harold Joyce

*Attorney, Agent, or Firm*—Frank Fusco

[57] ABSTRACT

A vestibule or housing for a stove made of stone, brick or metal for permanent installation on the outer side of a house of similar structure. The vestibule has inlet and outlet vents with blowers. Furthermore, the vestibule can accommodate any stove or heater like wood, coal, kerosene/oil or gas of different sizes and shapes.

2 Claims, 3 Drawing Figures

VESTIBULE FOR ANY STOVE

BACKGROUND OF THE INVENTION

This invention relates to a universal vestibule or housing for a stove. Stoves, such a wood, coal, kerosene/oil or gas are again gaining popularity and many stoves installed in homes are a fire hazard since they sit in a room where too much heat radiates from the stove toward the floor and walls of the room. A problem which is solved with the present invention is the vestibule provides a safe place for the stove thereby preventing such radiation.

SUMMARY OF THE INVENTION

The present invention relates to a universal vestibule or housing for a stove. The fabrication of the vestibule can be of stone, brick or metal. A feature of the metal vestibules is the preassembly of the parts. The platform is constructed and the parts are assembled on the platform.

The purpose of the present invention is (1) to provide a safe place for the stove, (2) to keep the stove out of the room, (3) provide inlet and outlet vents on the top part of the vestibule and below the platform for cooperating with blowers and making the stove a highly efficient heater, and (4) it can be used for—wood, coal, kerosene-/oil or gas stoves and in different sizes and shapes. The cooler air of the room enters at inlet vents in the platform of the vestibule and warm air will exit at outlet vents in the back part of the platform under the stove. The vents and blowers on the upper part of the vestibule will draw heat from the stove and stove pipe in the vestibule at inlet vent and this warm air will exit at the outlet vent into the room.

The invention will be better understood in the balance of the specification.

DETAILED DESCRIPTION

Figure 1:
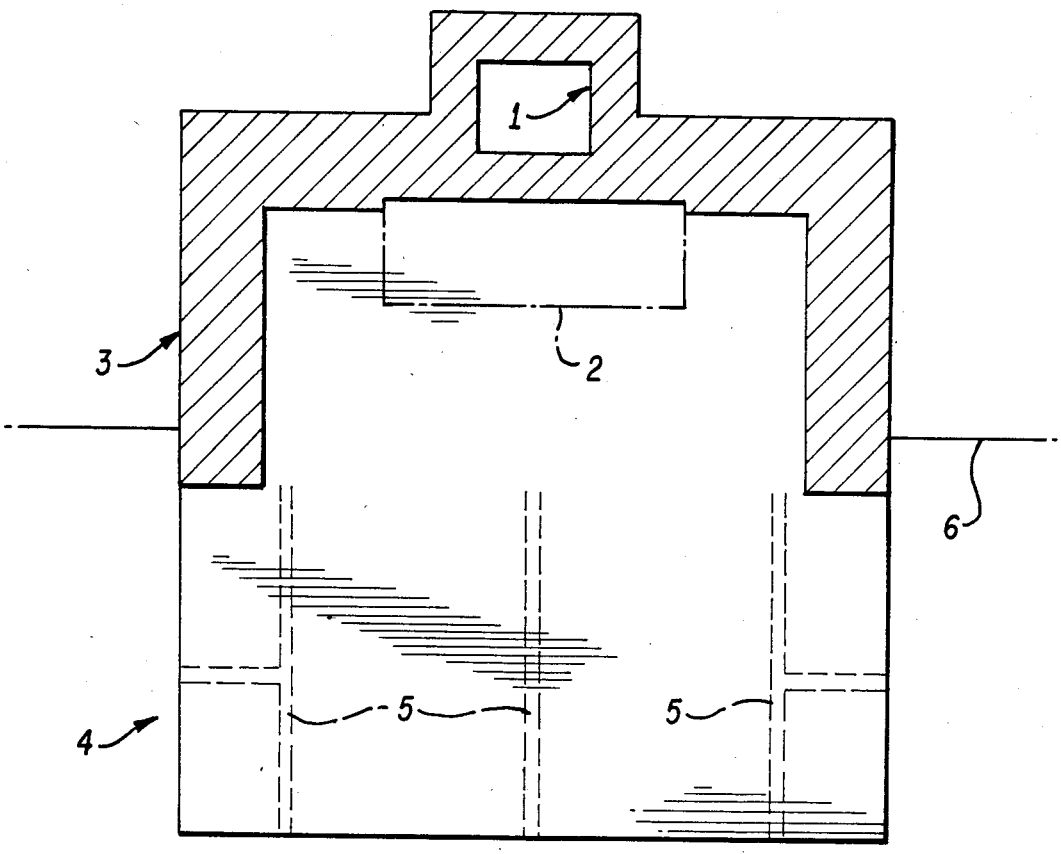
FIG. 1 shows a top cross sectional view taken horizontally through the center of the vestibule of this invention looking down.

Referring now to the drawings in more detail of the present invention. A vestibule is located in an opening in the building wall 6. As viewed in FIG. 1 that portion of the vestibule below the building wall 6 is the inside of the room or building and that portion above building wall 6 is the outside of the building. The vestibule 3 has a platform 4 where the stove sits. The platform 4 has ducts 5 through the platform. The ducts have inlet vents on the side surfaces thereof, three vents in front and one vent each on the right and left sides. The ducts terminate at an outlet vent 2 on the top surface of the platform. The blower 23 is located in the ducts for forcing room air there through.

Figure 2:
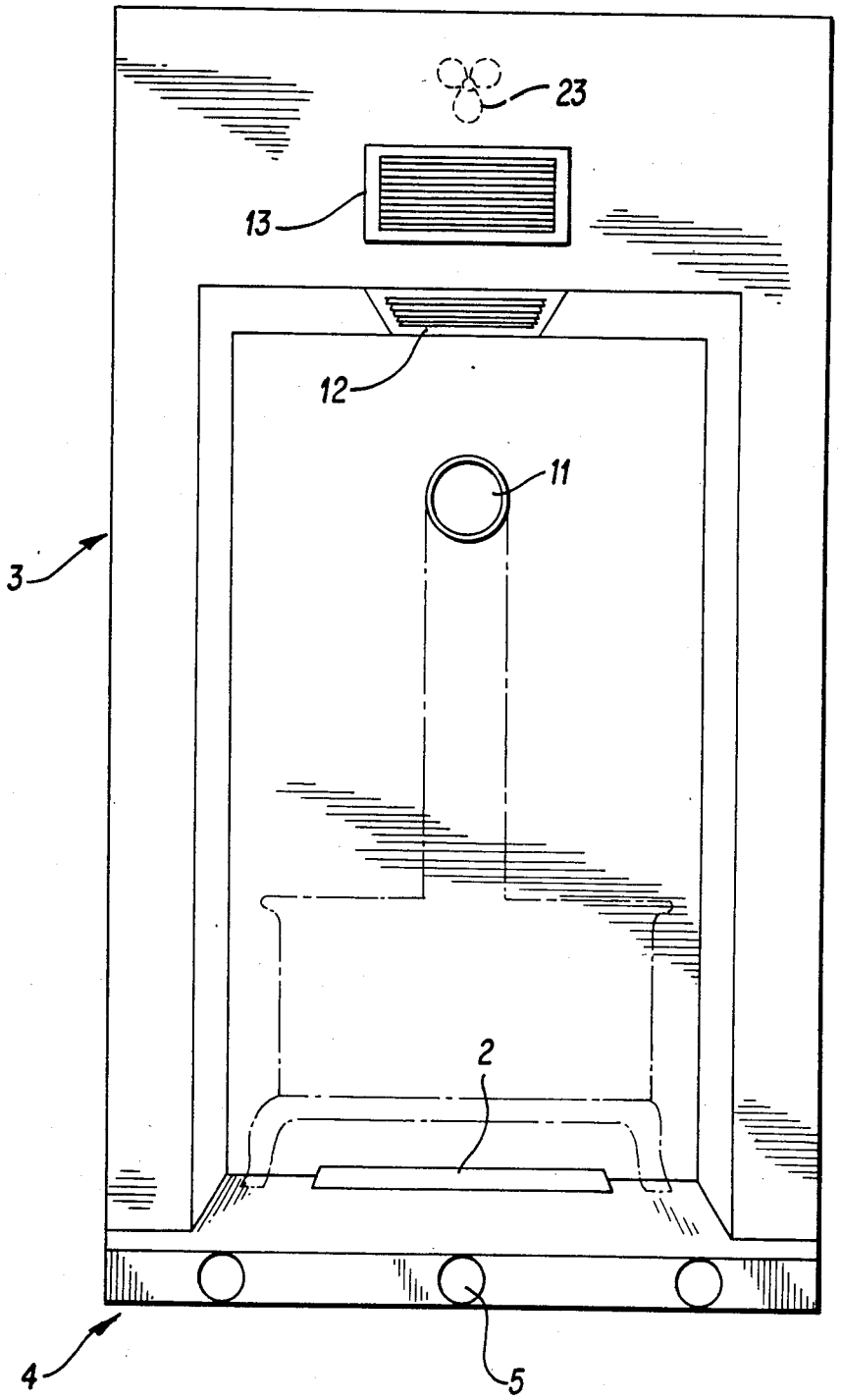
FIG. 2 shows a front view of the vestibule of this invention.

FIG. 2 shows the vestibule 3 facing the room in the building wall opening. The cooler air of the room goes into the inlet vent 5 in the platform 4 and reheated air comes out and returned to the room at the outlet vent 2. The top wall of the vestibule also has inlet vent 12 and outlet vent 13 at which the heated air from the stove and stove pipe wall enters at the inlet vent 12 and exits at the outlet vent 13 into the room. A blower 23 is positioned in a duct which communicates with and located between the vents. The back wall of the vestibule has an opening for the stove flue pipe.

Figure 3:
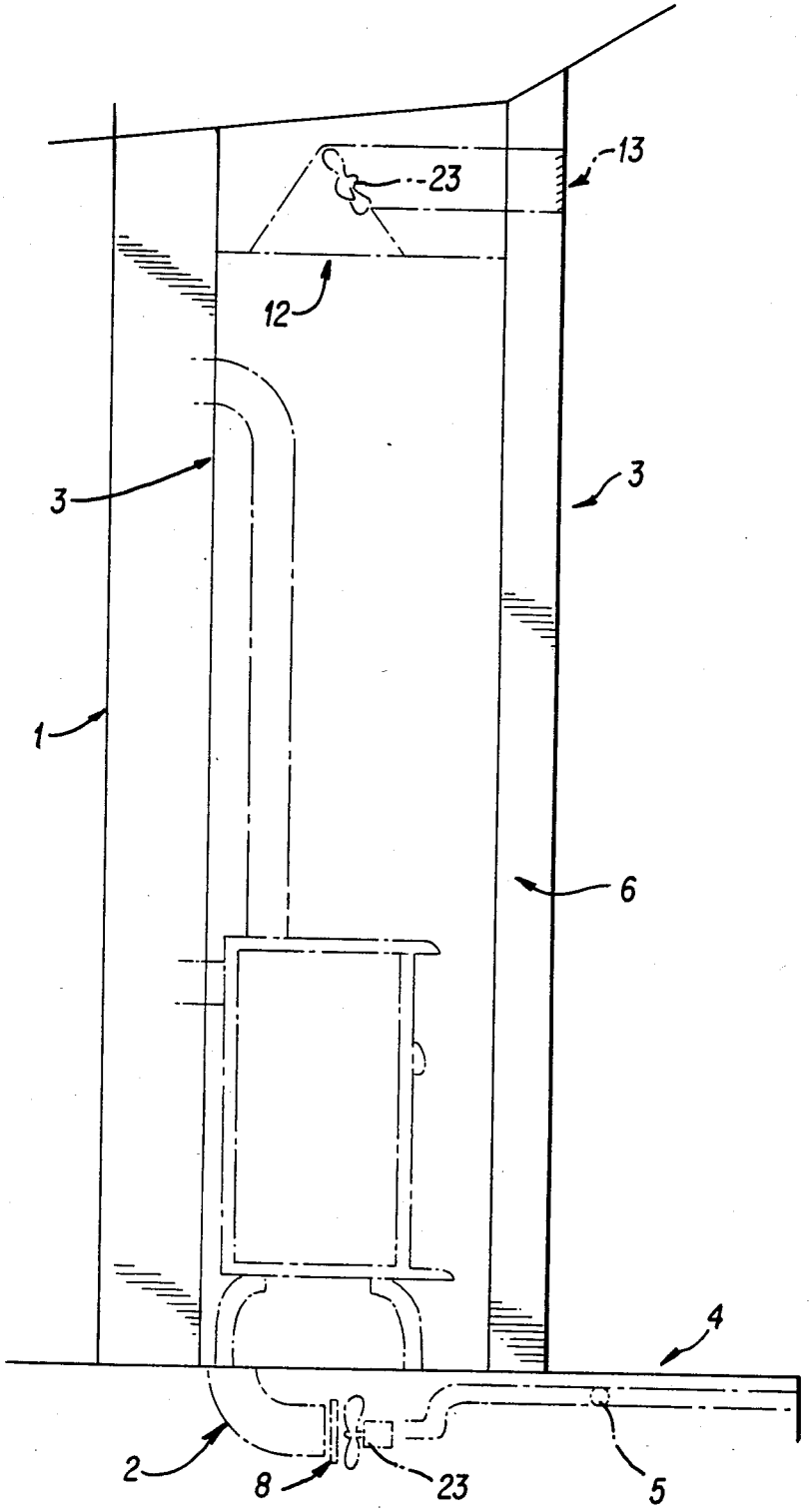
FIG. 3 shows a side view of the vestibule of this invention.

FIG. 3 shows the building wall line 6 looking at a side view of the vestibule 3 outside the building. The stove, shown in phamtom lines, has a stove pipe which can be installed on top portion or bottom portion of the flue. The blower is attached to the duct at connection 8.

A decorative non-combustible material can be inside the vestibule and aluminum or any suitable material can be on the outside of the vestibule. A suitable insulation material can be between the walls of the vestibule.

I claim:

1. A vestibule for a stove which will accommodate any stove or heater of different sizes and shapes for separating the stove or heater from the floor and wall of a room, said vestibule comprising (a) a platform arranged to form the bottom wall of said vestibule, opposite sidewalls extending upwardly from said platform, a backwall extending between said sidewalls, and a top wall at the upper ends of said opposite side and back wall, said vestibule having an opened front, (b) said platform including a top surface for supporting the stove or heater and also including a vertical front surface having lower air inlet openings therein, a lower air outlet opening in said top surface of the platform adjacent the backwall, lower conduit means in said platform for communicating said lower air inlet openings with said lower air outlet opening, and first electrically operated forced air circulating means positioned in said lower conduit means for drawing room air into said lower air inlet openings and forcing said air out of said lower air outlet opening whereby said air is heated by the radiation of the heat of the stove or heater through said top surface of the platform, (c) said top wall including a bottom surface and a vertical front surface, an upper air inlet openings in said bottom surface of the top wall and an upper air outlet opening in said front surface of the top wall, upper conduit means in said top wall for communicating said upper air inlet opening with said upper air outlet opening, and second electrically operated forced air circulating means positioned in said upper conduit means for drawing room air into said upper air inlet opening and forcing said air out of said upper air outlet opening whereby said air is heated by the radiation and convection from the heat of the stove or heater through said bottom surface of the top wall, and (d) said backwall having an aperture therein for accommodating a flue pipe of the stove or heater.

2. In the vestibule of claim 1, where in the wall of the room being provided with an opening therein, said vestibule opened front being mounted at the opening in said wall whereby said vestibule is positioned outside of the room.

* * * * *